US008955956B2

(12) United States Patent
Yamamoto et al.

(10) Patent No.: US 8,955,956 B2
(45) Date of Patent: Feb. 17, 2015

(54) PRINTING APPARATUS AND INKJET METHOD

(75) Inventors: Kosuke Yamamoto, Yokohama (JP); Tetsuya Saito, Yokohama (JP); Norihiro Kawatoko, Yokohama (JP); Osamu Iwasaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 13/090,493

(22) Filed: Apr. 20, 2011

(65) Prior Publication Data

US 2011/0267410 A1 Nov. 3, 2011

(30) Foreign Application Priority Data

Apr. 30, 2010 (JP) ..... 2010-105697

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
CPC .... B41J 11/002; B41J 11/0015; B41J 2/0057; B41J 2/01; B41J 2/17593; B41J 2/2114; B41J 11/0065; B41J 11/007; B41J 11/0085; B41J 11/06; B41J 13/103; B41J 29/17; B41J 2002/012; B41M 5/52; B41M 7/00; B41M 7/0072; C09D 11/101
USPC ..... 347/5, 6, 16–19, 101–104; 101/488; 34/114, 115, 304, 422; 219/216; 346/25; 399/320–342; 400/283
IPC ..... B41J 2/01
See application file for complete search history.

(56) References Cited

U.S. PATENT DOCUMENTS

| | | | | |
|---|---|---|---|---|
| 4,103,434 | A * | 8/1978 | Walker | 34/114 |
| 5,020,244 | A * | 6/1991 | Smith | 34/633 |
| 5,231,423 | A | 7/1993 | Wataya et al. | |
| 5,467,119 | A * | 11/1995 | Richtsmeier et al. | 347/102 |
| 6,439,712 | B1 * | 8/2002 | Mizutani et al. | 347/102 |
| 6,463,674 | B1 * | 10/2002 | Meyers et al. | 34/304 |
| 6,536,863 | B1 * | 3/2003 | Beauchamp et al. | 347/17 |
| 6,536,894 | B1 * | 3/2003 | Rasmussen et al. | 347/104 |
| 2003/0019125 | A1 * | 1/2003 | Hanaya | 34/114 |
| 2003/0156177 | A1 * | 8/2003 | Nishikawa et al. | 347/102 |
| 2003/0160852 | A1 * | 8/2003 | Pickup | 347/102 |
| 2004/0041893 | A1 * | 3/2004 | Hoshino | 347/102 |
| 2005/0253912 | A1 * | 11/2005 | Smith et al. | 347/102 |
| 2006/0001721 | A1 * | 1/2006 | Yraceburu et al. | 347/102 |
| 2006/0222385 | A1 * | 10/2006 | Serita | 399/44 |
| 2007/0296790 | A1 * | 12/2007 | Nakazawa et al. | 347/102 |
| 2010/0002038 | A1 * | 1/2010 | Onozawa et al. | 347/17 |

FOREIGN PATENT DOCUMENTS

JP 2001-071474 A 3/2001

* cited by examiner

*Primary Examiner* — Manish S Shah
*Assistant Examiner* — Roger W Pisha, II
(74) *Attorney, Agent, or Firm* — Fitzpatrick, Cella, Harper & Scinto

(57) ABSTRACT

In a printing apparatus improvement of drying ability and reduction of consumed power are concurrently achieved by improving the efficiency of drying ink. More concretely, hot air is blown onto a print medium printed by ink, and a portion of the blown hot air is recovered and blown again. Before the hot air is blown, the print medium is heated by a preheating unit, making it higher than the dew point temperature of the blown hot air.

5 Claims, 16 Drawing Sheets

FIG.11
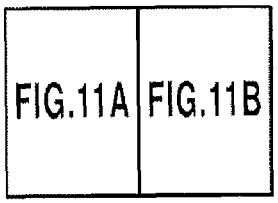
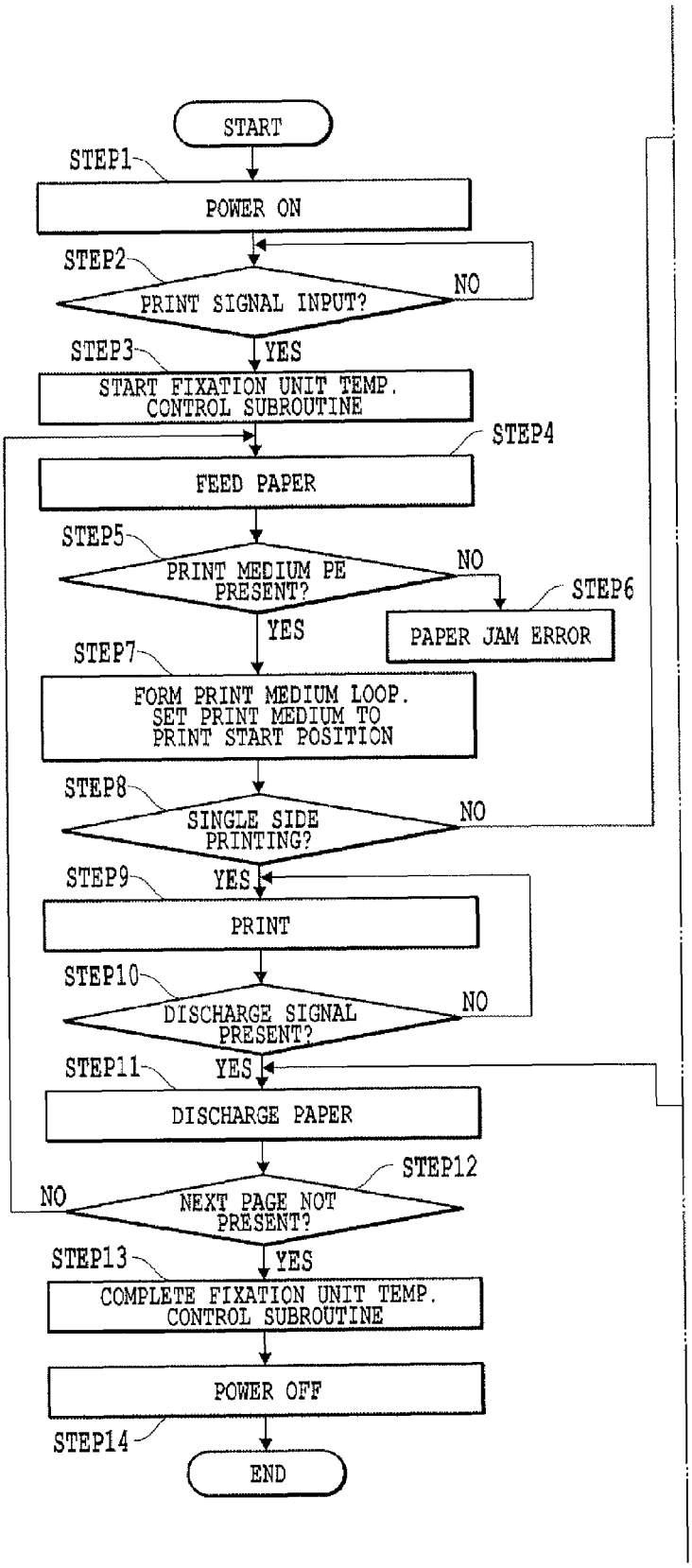
FIG.11A

PRINTING APPARATUS AND INKJET METHOD

BACKGROUND OF THE INVENTION

1. Field of the Invention

The present invention is related to a technical field that concerns inkjet printing, and the like, capable of fixing, by hot air, an image printed by the application of ink to a print medium.

2. Description of the Related Art

Printing apparatuses, such as inkjet printers and the like, that facilitate the fixation of a printed image by blowing hot air onto an image printed by the application of ink onto a print medium, are known in the prior art. As one such printing apparatus, Japanese Patent Laid-open No. 2001-071474 discloses an apparatus that circulates hot air by returning to a blowing mechanism, provided with an air heating heater and a fan, hot air that has been blown from the blowing mechanism onto an image printed on a print medium. This type of hot air circulation structure can reduce the heat energy of a heater that is necessary for regulating air to a prescribed temperature, and has an advantage in that it is suited for energy conservation.

However, when hot air is circulated the humidity of the hot air generally increases due to vapor evaporated from the printed image. In particular, the amount of this evaporated ink becomes large and the increase of humidity in the hot air becomes marked when continuously printing multiple pages of print media and when performing a high duty printing wherein the ink ejected per unit area is increased.

When the humidity of air (hot air) circulated in this manner increases, the dew point temperature also increases. In this case, when the temperature of the print medium, which has been exposed to hot air in order to dry it, becomes lower than the dew point temperature due to the influence of the ambient temperature or the like, condensation of moisture in the hot air occurs and moisture adheres to the print medium. For this reason, drying of the image printed on the print medium becomes insufficient, moisture within the print medium increases, and because of this a problem occurs wherein the drying efficiency is decreased.

SUMMARY OF THE INVENTION

An object of the present invention is to provide an apparatus and method wherein improvements of drying ability and reduction of consumed power are concurrently achieved by improving the ink drying efficiency.

In a first aspect of the present invention, there is provided a printing apparatus comprising:

a printing unit that carries out printing on a print medium; a fixation unit provided with (i) a blowing mechanism that blows hot air onto the print medium on which printing is performed by the printing unit and which is conveyed in a direction and (ii) a structure that returns the hot air blown onto the print medium to the blowing mechanism; and a preheating unit for heating the print medium at an upstream side of an area in the direction, in which the hot air flows in the fixation unit;

wherein temperature of the print medium heated by the preheating unit is made higher than dew point temperature of the hot air at the fixation unit.

In a second aspect of the present invention, there is provided an inkjet method comprising the steps of: applying ink to a medium in an inkjet method; drying the medium on which the ink has been applied by blowing hot air onto the medium; recovering a portion of the hot air blown onto the medium and blowing the medium again; and preheating a part of the medium before the hot air has been blown onto the medium.

According to the configuration above, the temperature of a printing medium, heated by preheating, is made higher than the dewpoint temperature of the hot air at the fixation unit. Thereby, even if ink moisture evaporates at the print medium due to the hot air, and the dew point temperature increases due to the humidity of the hot air increasing, it is possible to prevent condensation of moisture in the hot air onto the print medium. As a result it is possible to improve ink drying efficiency, and the concurrent improvement of drying ability and reduction of consumed power is enabled.

Further features of the present invention will become apparent from the following description of exemplary embodiments (with reference to the attached drawings).

BRIEF DESCRIPTION OF THE DRAWINGS

FIG. 11 is a diagram showing a relationship between

FIGS. 11A and 11B and FIGS. 11A and 11B are flowcharts that illustrate the printing processes that accompany the printed image fixation process of the printing apparatus of the first embodiment;

DESCRIPTION OF THE EMBODIMENTS

Figure 1:
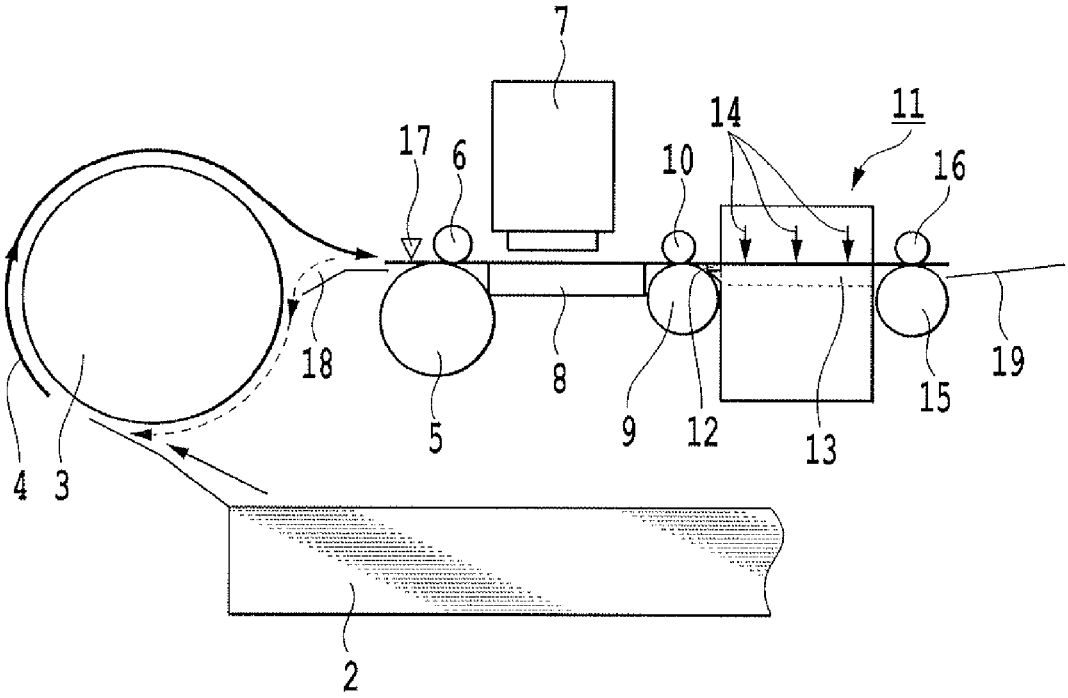
FIG. 1 is a schematic view of the inkjet printing apparatus of a first embodiment of the present invention, and in particular the structure along the print medium conveyance path.

Embodiments of the present invention will be described in detail below while referring to the drawings.

(Embodiment 1)

FIG. 1 is a schematic view of the inkjet printing apparatus according to a first embodiment of the present invention, and in particular the structure along the print medium conveyance path. It should be noted that the present invention can also be applied in printing apparatuses other than inkjet type apparatuses, in which drying of the print medium after printing is necessary for fixation.

In FIG. 1 the print medium is a cut sheet, which can be set to a maximum of 250 sheets inside a sheet feeding cassette 2, and is picked up and fed one sheet at a time by a sheet feeding roller and separation mechanism (not shown). A U-turn conveying unit 3 conveys, along with an unshown conveyance roll, the print medium in the direction shown by the arrowed line 4. The U-turn conveying unit 3 also functions as a double-side inversion unit, as described later. The print medium, which is conveyed along the direction of the arrow 4, is held between a LF roller 5 and a pinch roller 6, and conveyed directly below a print head 7 by way of the rotation of these rollers. The print head 7 ejects ink by an inkjet method. Inkjet methods are capable of adopting methods that use heat generation elements, methods that use piezoelectric elements, methods that use electrostatic elements, and methods that use MEMS elements, for example. The print head 7 is mounted on an unshown carriage by which it scans over the print medium in a main scanning direction (a direction perpendicular to the paper surface of the figure), and performs printing by ejecting and applying ink to the print medium during these scans. An unshown encoder is provided that rotates about the same axis as the LF roller 5. By way of this it is possible to convert the amount of rotation of the RF roller 5 into a conveyed distance of the print medium, and detect the amount of rotation at a 1/2400 inch resolution. The PE sensor 17 (paper edge sensor) is arranged just in front of the LF roller 5 along the conveyance path and optically detects the passage of the front edge and the back edge of the print medium. The platen 8 supports the conveyed print medium from its back surface side. The discharge roller 9, along with the roll 10, sandwich and convey the print medium at the downstream side of the area printed by the print head 7. The fixation unit 11 has a blowing fan and a nichrome wire heater furnished in its interior. In the fixation unit 11, air controlled to a temperature of 80° C. is blown in the direction of the arrows 14, approximately perpendicularly onto the print medium, and the ink applied on the print medium is dried. The length of the fixation unit 11 of the present embodiment is 3 inches in the print medium conveyance direction. The discharge roller 15 is provided downstream of the fixation unit and sandwiches and conveys the print medium along with the roll 16. A fixation platen 13 is provided in the interior of the fixation unit 11 and supports the print medium conveyed in the fixation unit from its back surface. The fixation platen 13 extends to the upstream side of the fixation unit 11, and a surface heater 12 used for preheating is provided at the portion extended to this upstream side. The print medium can be heated from the back side with this heater 12. The particulars of the fixation unit and the surface heater 12 used for preheating will be described later. In this way it is possible to, at the fixation unit 11, dry ink that has been ejected from the print head 7 and applied onto the print medium. The print medium, which has exited the fixation unit 11, is discharged into a discharge tray 19 by conveyance.

When printing on both sides, the discharge roller 9 and roll 10, and the discharge roller 15 and the roll 16 are stopped for a moment, in a state where the print medium is sandwiched between them. Next, these rollers are rotated in reverse, and after the back edge of the print medium at the front side printing passes LF roller 5, it is conveyed along the broken arrowed line 18, wound around the U-turn conveyance unit 3 and once again sandwiched between the LF roller 5 and the pinch roller 6. During conveyance of the print medium in the direction of the arrow 18, an unshown flapper acts to switchover and control the direction of advancement of the print medium. When sandwiched again by LF roller 5 and pinch roller 6, the two sides of the print surface are reversed, and the side on which printing has been completed is face down. After this, back side printing is carried out in the same manner as when printing the front surface, and after passing the fixation unit it is discharged into the discharge tray 19 by rotation of the discharge roller 15 and the roll 16.

Figure 2:
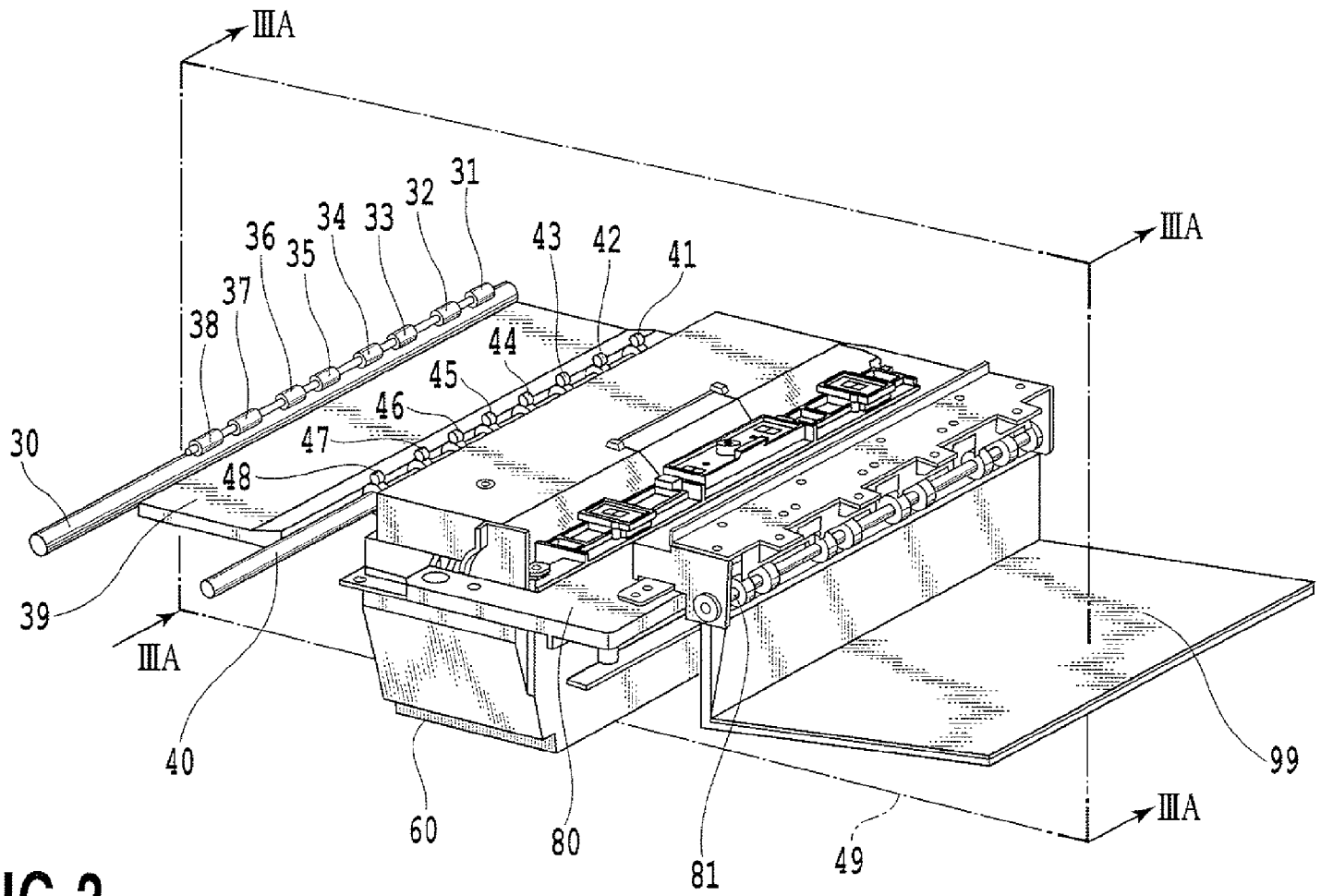
FIG. 2 is a perspective view that illustrates the fixation unit of the first embodiment, and conveyance units that are upstream and downstream of the fixation unit, along the conveyance path.
Figure 3A:
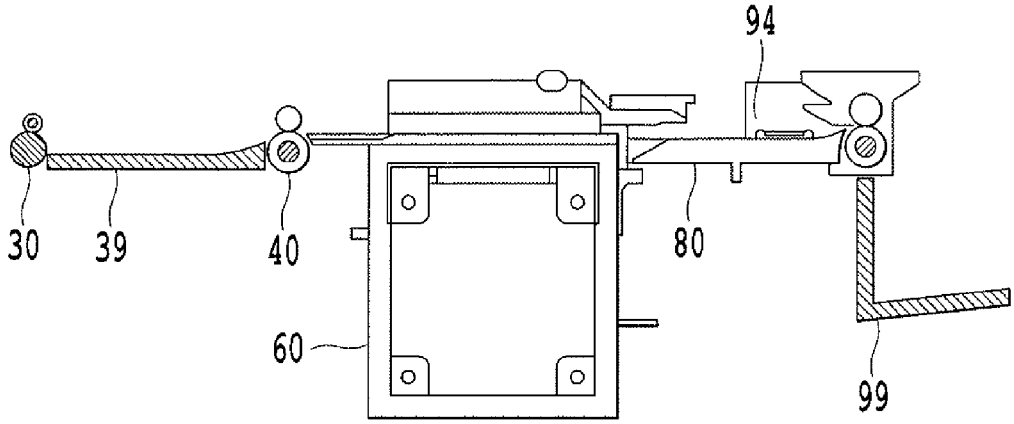
FIG. 3A is a cross sectional view cut along the imaginary cross section 49 of FIG. 2.
Figure 3B:
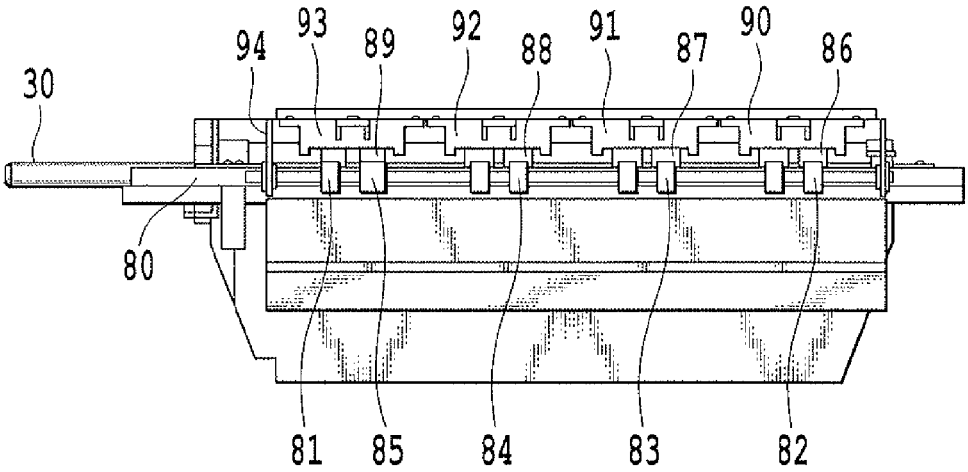
FIG. 3B is a front view of the structure shown in FIG. 2, as seen from the discharge side.

The detailed structure in the area of the fixation unit will now be explained while referring to FIGS. 2, 3A and 3B. FIG. 2 is a perspective view that shows the fixation unit and the conveyance unit on the upstream side and downstream side of the fixation unit, and FIG. 3A is a cross sectional view of FIG. 2 cut by the imaginary plane 49. FIG. 3B is a front view of the structure shown in FIG. 2, as seen from the discharge side.

In FIGS. 2, 3A and 3B the conveyance roller 30 is a roller for conveying the print medium, and is a part that corresponds to the LF roller 5 shown in FIG. 1. Each of the pinch rollers 31 to 38 have the same shape, and 8 of them are provided at locations where a maximum width print medium (for example, letter size paper) can be sandwiched along with the conveyance roller 30. The pinch rollers 31 to 38 are supported by an unshown pinch roller guide, and due to this roller guide being biased by an unshown spring, the pinch rollers 31 to 38 press down on the conveyance roller 30 with a prescribed load. As described at FIG. 1, the platen 39 is at a location facing the print head and supports the conveyed print medium. The discharge roller 40 is configured with 8 rollers, which are made out of rubber, fixed along a central axis. Spurs 41 to 48, which face each of these rollers, are attached to an unshown spur stay through an unshown spring shaft, and are thereby pressed onto the above corresponding rollers. Due to the conveying roller and pinch roller pairs and discharge roller and spur pairs revolving at the same circumferential velocity, and conveying and supporting the print medium, floating away of the print medium from the platen 39 is suppressed, and along with keeping the printing surface flat, rubbing between the nozzle surface of the print head and the print medium is prevented. Also, due to suppression of the flotation of the print medium front edge, it is possible to make the print medium smoothly advance into the entrance of the fixation unit to be described later. The print medium, which has exited from the fixation unit 60, advances onto the discharge platen 80, is sandwiched by the discharge roller 81 and the discharge rolls 82 to 85, and discharged. The discharge roller 81, in the same way as the discharge roller 40, is configured with a total of 8 rubber rollers provided. The four discharge rolls 82 to 85 are configured to face the 8 rollers of the discharge roller 81. The discharge rolls 82 to 85 have holes opened through the centers of their cylinders, and the spring axes 86 to 89 are inserted in these holes. Both ends of the spring axes 86 to 89 are inset and fixed into the roll holders 90 to 93. Furthermore, each of the roll holders is fixed to the discharge roll stay 94 by unshown screws. The discharge roll stay 94 is fixed to the above mentioned discharge platen 80 by unshown screws. Driving force is transmitted by an unshown drive force transmission means (gear) from the axis of the discharge roller 40 to the discharge roller 81, and it thus rotates at the same circumferential speed as the discharge roller 40. Because the discharge rolls 82 to 85 convey a print medium after it has passed through the fixation unit 60, the print medium has already dried and the rubbing or transfer of ink does not occur even though there is contact with the rolls. The print medium, which has been discharged by the discharge roller 81, is stored in the discharge tray 99.

Figure 4A:
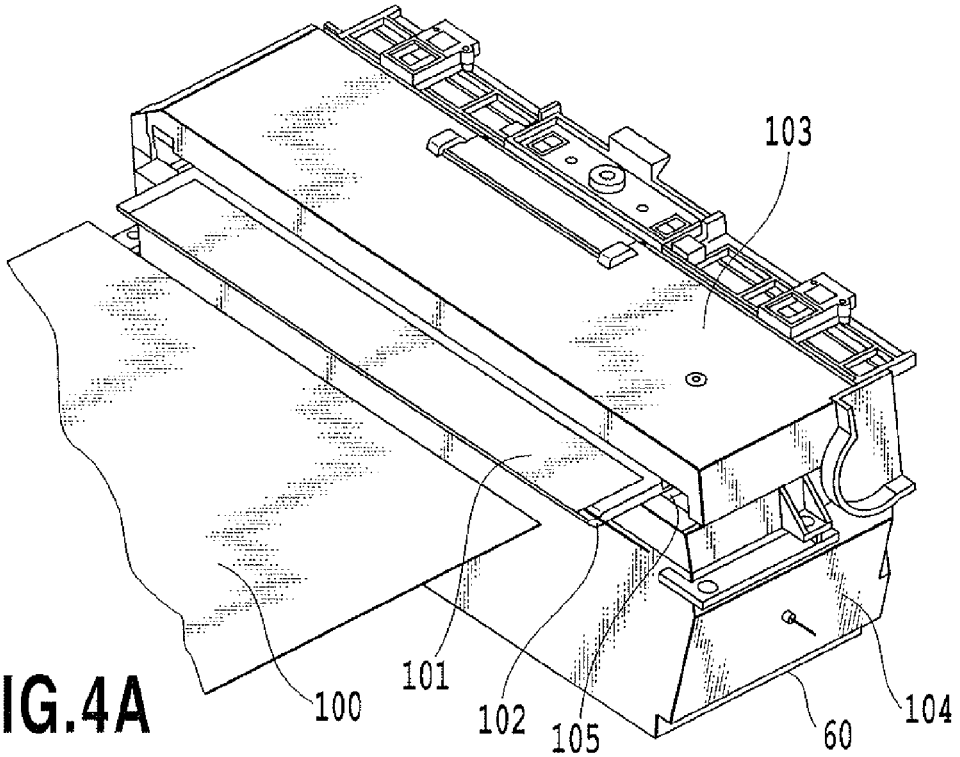
FIG. 4A is a perspective view of the fixation unit of the first embodiment, viewed from the upstream side of the print medium conveyance path.
Figure 4B:
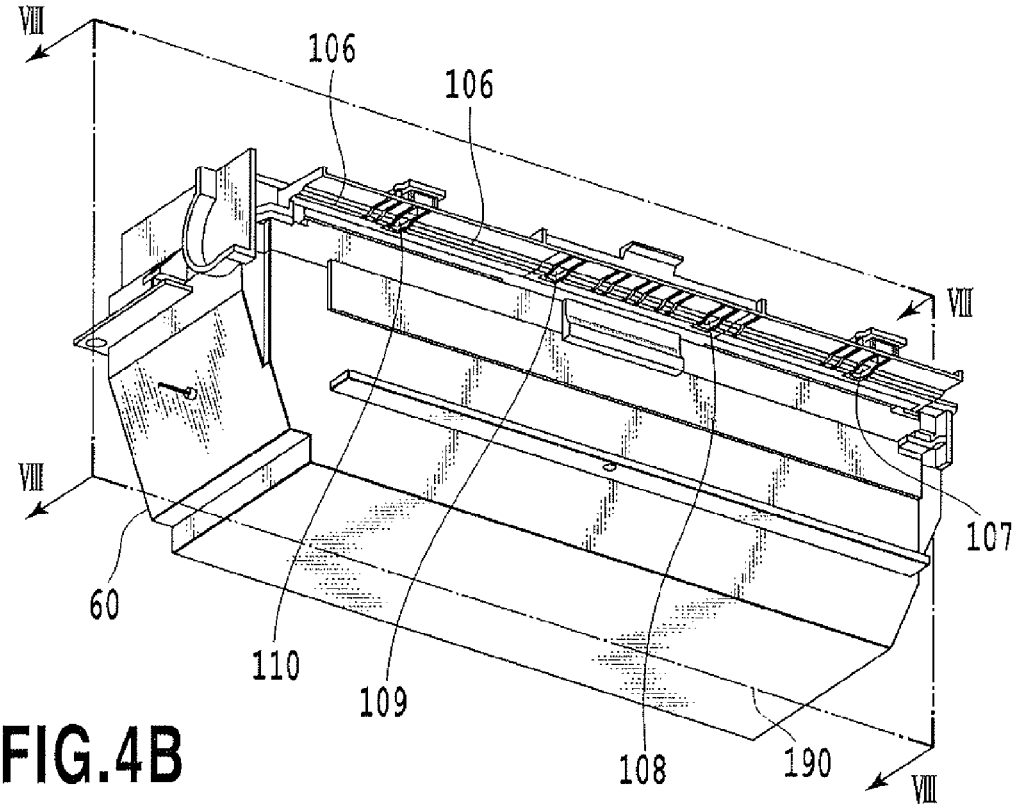
FIG. 4B is a perspective view viewed from the downstream side.

Next, the detailed structure of the fixation unit of an embodiment of the present invention will be described while referring to FIGS. 4 to 9. FIG. 4A is a perspective view of the fixation unit 60 viewed from the upstream side of the print medium conveyance path, and FIG. 4B is a perspective view viewed from the downstream side. In FIG. 4A the print medium 100 is conveyed towards the fixation unit 60 by a discharge roller or the like, omitted from the figure. The silicone rubber heater 101, used for preheating, is adhesively fixed on the later described fixation platen unit 102 by a heat resistant adhesive. The silicone rubber heater 101 has a width that approximately corresponds to the maximum width of the print medium used, and heats the conveyed print medium 100 from its back side. The electric power per unit area (watt density) when applying 100V is 1 W/cm$^2$, and therefore when applying 100V the consumed power of the entire heater is approximately 50 W. The temperature of the silicon rubber heater 101 can be raised from 25° C. to 100° C. within 40 seconds because its thickness is approximately 1 mm thin and its heat capacity is small. As described later, because the actual preset temperature is at or below 50° C., at the longest it is possible to raise the temperature to the preset temperature in approximately 15 seconds. Reference sign 103 denotes a fixed top cover unit and reference sign 104 denotes a fixed case unit. The print medium 100, by way of being conveyed, advances to the admission port 105 of the fixation unit 60 and exits from the discharge port 106 (FIG. 4B). Four pressure rolls 107 to 110 are provided at the upper portion of the discharge port 106 such that the front edge of the print medium 100 may be kept down to a certain height even if it temporarily curls. Reference sign 190 denotes an imaginary cross section, and FIG. 8 is a cross sectional view cut by this plane.

Figure 5:
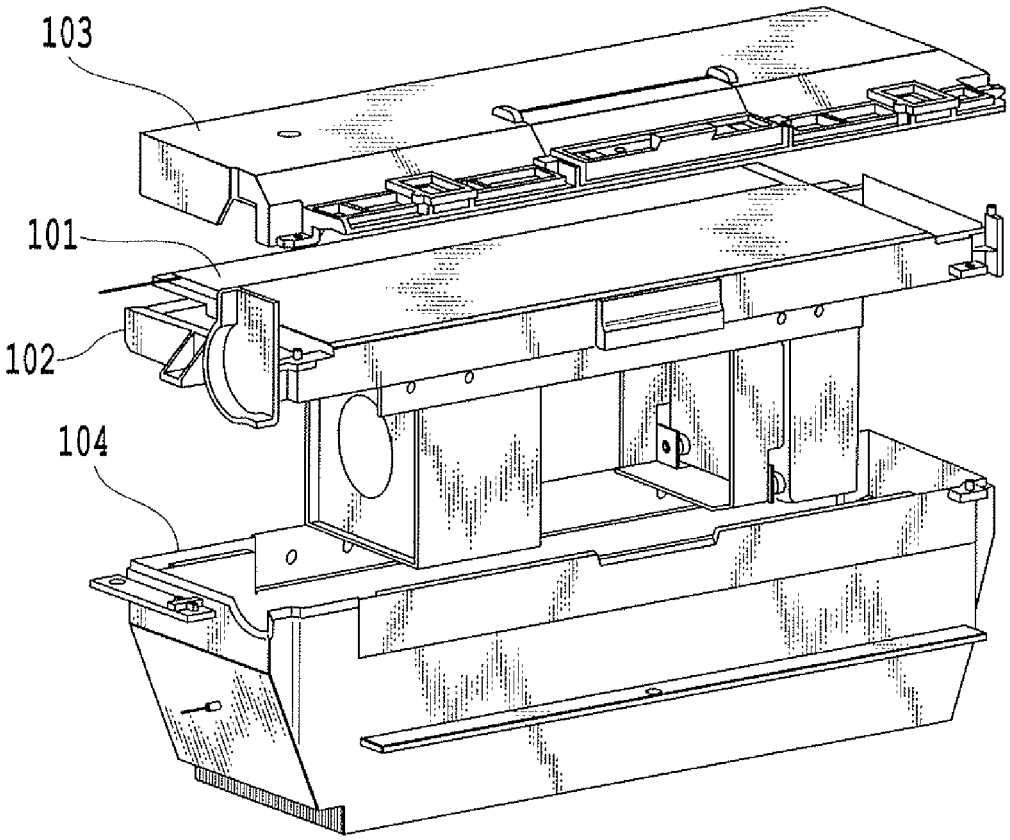
FIG. 5 is a disassembled perspective view for explaining the internal configuration of the above fixation unit, showing each of the units separated along the height direction.

FIG. 5 is a disassembled perspective view for explaining the internal configuration of the fixation unit 60, showing each of the units separated along the height direction. Largely separated along the up and down direction are 3 units; a top cover unit 103, a fixation platen unit 102, and a fixation case unit 104. Each of these 3 units will be explained below.

Figure 6:
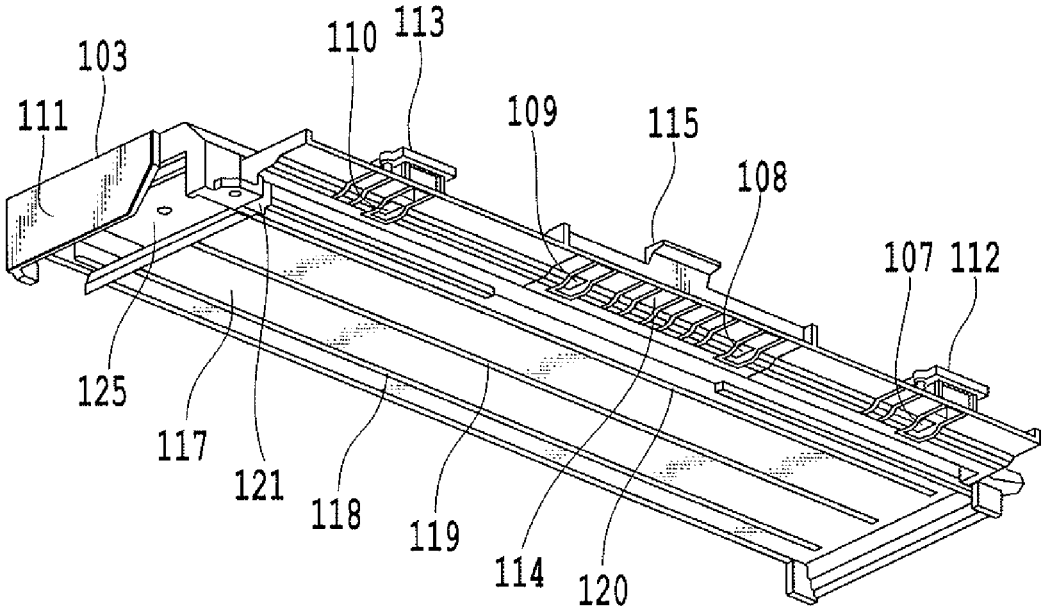
FIG. 6 is a perspective view of the top cover unit of the first embodiment, viewed from the downstream side.

FIG. 6 is a perspective view of the top cover unit 103 viewed from the downstream side. 111 denotes a top cover, and as mentioned above there are pressure rolls 107 to 110 attached to this top cover. Reference signs 112 and 113 denote lid members such that the rolls 107 to 110 do not come off, and these lid members are fixed to the top cover by their own hooks. Reference sign 114 denotes a movable cover for card-size jam processing, and FIG. 6 shows it in a closed state. Because the card size has a length of approximately 90 mm, in the case where there is the occurrence of a jam inside the fixation unit 60, it is troublesome to take out the print medium that has caused the jam. Because of this, the cover is provided with the intention of opening it and carrying out the process. Whether it is in an open or closed state the cover is capable of latched by means of an unshown mechanism. Rolls 108 and 109 are attached to the card-size jam processing use moveable cover 114, and are set up such as not to come off due lid member 115, similar to lid members 112 and 113.

Figure 8:
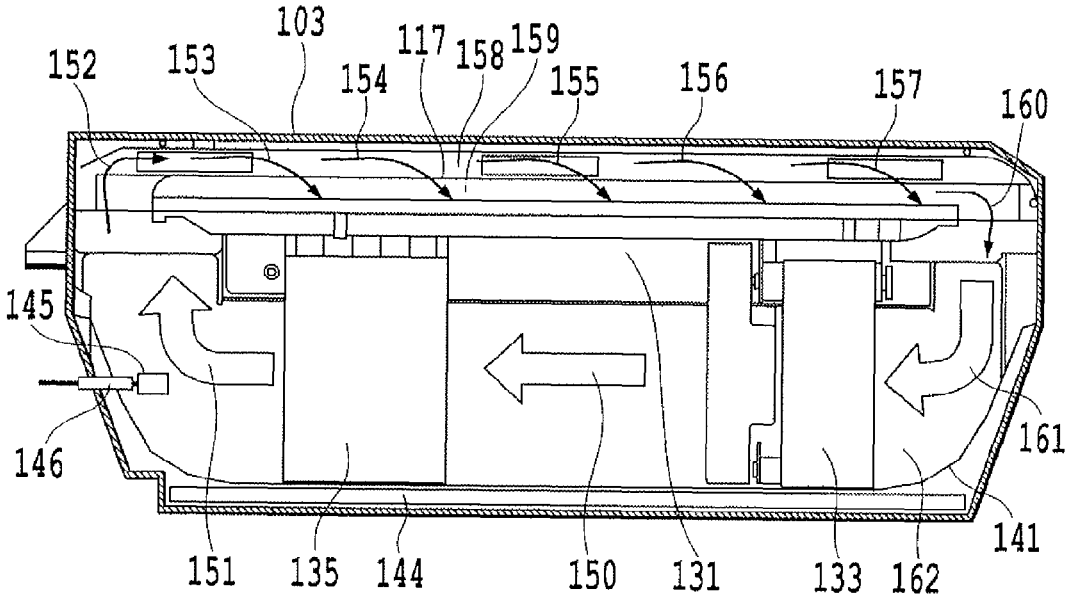
FIG. 8 is a cross sectional view of the entire body of the fixation unit, cut by the imaginary cross section 190 shown in FIG. 4B.

In FIG. 6 and FIG. 8 the plate 117 is a hot air blowing plate made out of a thin sheet of aluminum, and is provided with 3 blowing slits 118 to 120. The heat insulating top cover plate 125 is fixed in a state wherein a 2 mm crevice is maintained between it and the top cover 111. The heat insulating top cover plate 125 is made from aluminum and its front surface is processed such that it is flat and smooth. Because the radiation refraction ratio of the smooth aluminum surface is at or above 80%, along with blocking off heat radiated from the interior of the fixation unit, it becomes an energy saving structure in which a layer of air is maintained on the upper side of the insulating top cover plate 125, insulation occurs due to the low heat conductivity rate of air, and heat is restrained from escaping to the outside. The hot air blowing plate 117 is fixed to the top cover 111 and the insulating top cover plate 125 with four spacers in between. In this manner a hot air path, to be described later, is formed between the insulating top cover 125 and the hot air blowing plate 117.

Figure 7A:
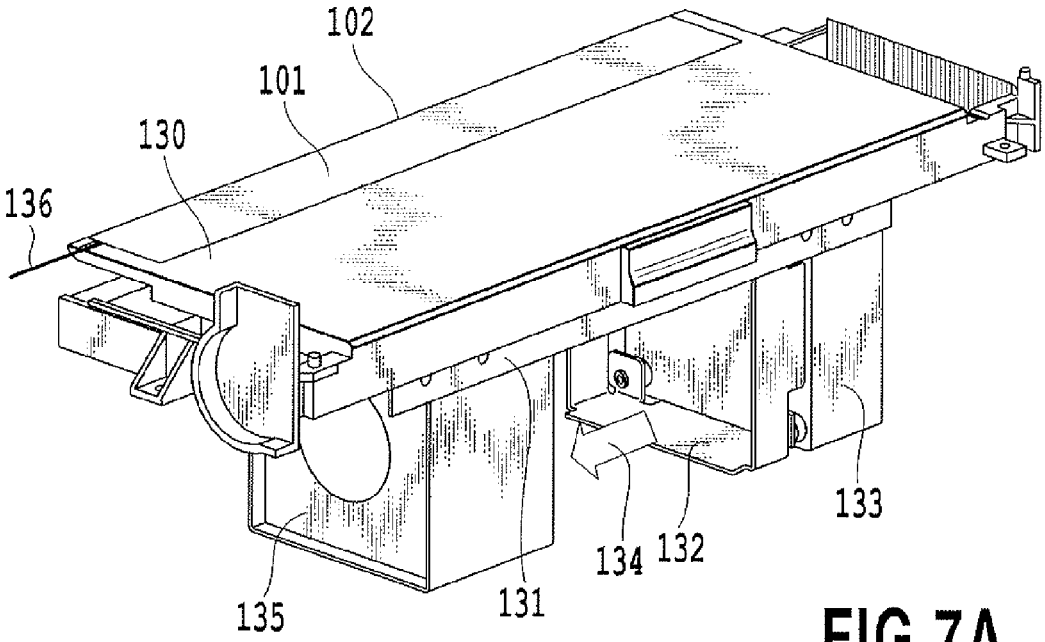
FIG. 7A is a perspective view that illustrates the fixation platen unit of the first embodiment.

FIG. 7A is a perspective view showing the fixation platen unit 102. As described above, a silicon rubber heater 101 is affixed onto the fixation platen 130, made from resin. The preheating temperature sensor 136 is affixed to the back surface of the silicon rubber heater 101, and uses a thermistor. The preheating temperature sensor 136 detects the back surface temperature of the silicon rubber heater 101, and the temperature of the silicon rubber heater 101 is controlled based on this temperature. The silicon rubber heater 101 has a thickness that is 1 mm thin and because of this there is almost no temperature difference with the front surface. Also, the temperature of the print medium at the point in time where it has advanced to the fixation unit after being conveyed over the silicon rubber heater 101 can also be obtained by experiment. The curled condition of the print medium varies, but even in the lowest case the temperature of the print medium is a temperature 3° C. lower than the temperature detected by the preheating temperature sensor 136. In other words, it has been confirmed by experiment that, after the conveyed print medium has been heated by the silicon rubber heater 101, the temperature of the print medium at the point in time where it enters the fixation unit does not become more than 3° C. lower than the temperature of the silicon rubber heater 101, as detected by the preheating temperature sensor 136. A fixation platen plate 131, made from aluminum, is fixed to the bottom surface of the fixation platen 130 by unshown screws. The material properties of the fixation platen plate 131 are the same as the insulating top cover plate 125. An axial flow fan 133 is fixed by screws to the fixation platen plate 131 through a fan mounting bracket 132. This fan 133 has dimensions of 60 mm×60 mm×25 mm, a maximum flow rate of 0.7 m$^3$/min and a capacity with a maximum static pressure of 70 Pa, and generates airflow in the direction of the arrow 134 of the figure. Reference sign 135 denotes a hot air heater with its perimeter surrounded by stainless steel, and a nichrome wire wound into a coiled shape fixed to its interior through an unshown insulator or the like. The maximum rated power of the nichrome wire is 200 W, and by adjusting the applied voltage in a range up to 100V it is possible to change the surface temperature of the nichrome wire. It is possible to generate hot air by simultaneously driving the axial flow fan 133 and the hot air heater 135 in this manner.

Figure 7B:
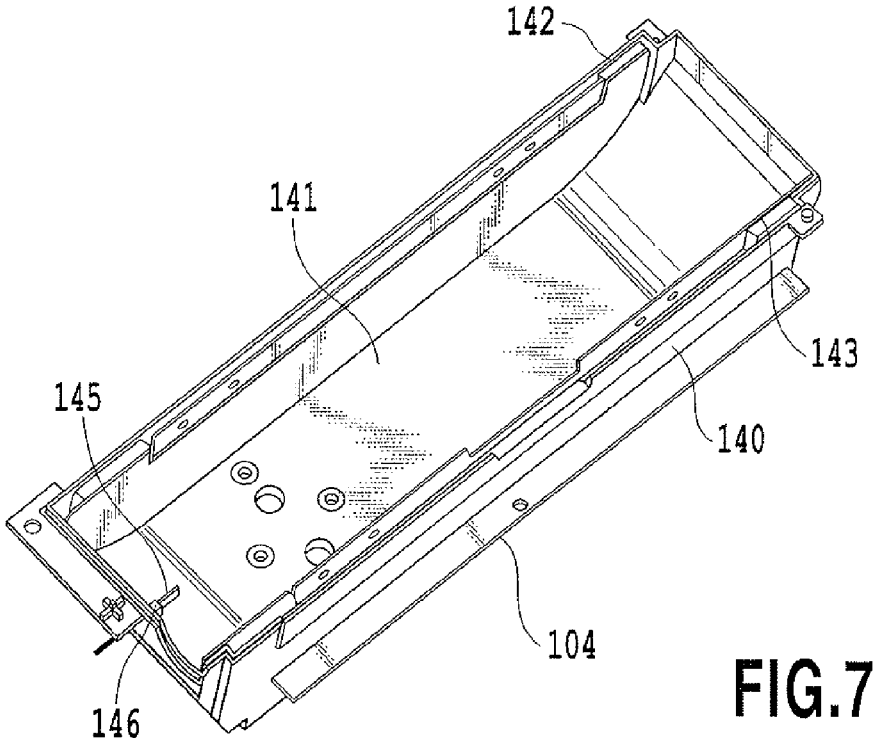
FIG. 7B is a perspective view illustrating a fixation case unit.

FIG. 7B is a perspective view showing the fixation case unit 104. Also, as described above, FIG. 8 is a cross sectional view of the entire body of the fixation unit, cut by the imaginary cross section shown in FIG. 4B. In these figures the fixation case 140 is made from ABS resin. The inner case 141 is inset with a clearance of approximately 4 mm maintained between it and the inside of the fixation case 140, and is made out of aluminum sheet. An insulation sheet A, 142, an insulation sheet B, 143 and an insulation sheet C, 144 are inserted into this clearance portion. These insulation sheets use melamine resin foam or the like. A high insulating effect can be obtained because the heat conductivity rate is as low as 0.03 W/mK, and furthermore because air convection due to minute leakage of air outside of the inner case does not occur due to filling the clearance portion with insulating material. The inner case 141 is made from the same material as the above described insulating top cover plate 125. As can be understood from FIG. 8 the heat radiated from the hot air heater 135 is multiply reflected by the internal inner case 141 and the smooth aluminum surface of the fixation platen plate 131, and the portion that goes outside is at or less than 20%. Furthermore, the portion that has left is insulated by the above described insulation sheet. Due to the combination of these heat shielding and heat insulation structures it is possible to suppress the escape of heat energy outside of the case to a minimum.

The temperature/humidity sensor 145 is fixed to the cylinder shaped sensor holder 146, inserted in the fixation unit, and measures the temperature and humidity of the internal hot air. The temperature/humidity sensor 145 is an integration of a thermistor, which is a temperature detection sensor, and a polymer membrane humidity detection sensor that measures the relative humidity of the atmosphere from the permittivity change accompanying the absorption and emission of moisture by the polymer membrane. In addition it is also possible to use a thermocouple, a ceramic humidity sensor that uses the electrical conductivity difference of a porous ceramic that easily absorbs vapor, or the like, as a sensor. In the present embodiment, as described later, uneven temperature or humidity distributions inside the fixation unit largely do not occur because hot air is circulated. Because of this temperature difference and humidity difference attributable to the mounting position of the sensor are small. Therefore from the standpoint of detection the sensor may be placed anywhere within the fixation unit. However, taking into consideration the avoidance of a large escape from the hot air passage, and the avoidance of contact between the sensor and the print medium, it is positioned at the location shown in FIGS. 7B and 8, where the hot air passage area is comparatively large and separated from the path of the print medium.

The hot air circulation created by the combination of the 3 units described above, and drying and fixation of the printed image due thereto, will be explained next while referring to FIG. 8.

The air current generated by the axial flow fan 133 is blown in the direction of the arrow 150 in the figure, is heated by the hot air heater 135 and thus becomes hot air. Next, the hot air flows along the direction shown by the arrows 151 and 152, and flows into the upper layer portion 158 of the top cover unit 103. After that the hot air passes through slits 118 to 120 of the hot air blowing plate 117, forms the flow path shown by the arrows 153 to 157, and flows into the lower layer portion 159. Thus the hot air hits the (unshown) print medium, conveyed onto the fixation platen 130, at an angled direction. The creation of this kind of hot air path is for elevating the rate of heat transfer from the hot air to the ink on top of the print medium. In order to elevate the heat transfer rate it is necessary to break the airflow boundary layer above the print medium and reduce the insulating effect caused by the air above the print medium. Because in order to break the boundary layer it is preferable to increase the wind speed vector component that collides perpendicularly with the print medium, a structure, as above, with an upper layer and a lower layer is used. The holed portion of the hot air blowing plate 117 is not limited to slits; a plurality of holes or the like may also be used.

Figure 9A:
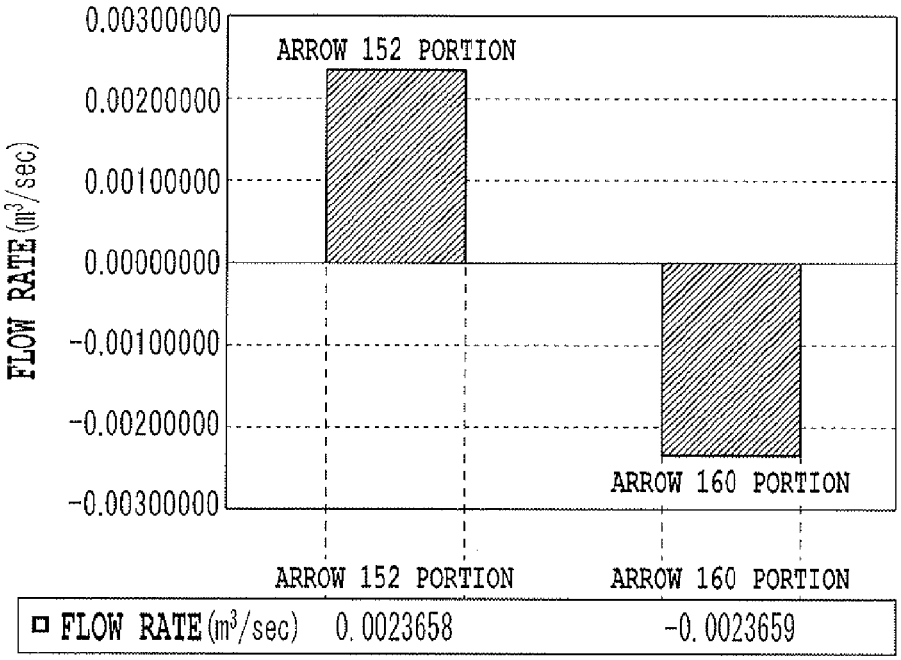
FIG. 9A is a graph illustrating flow volume results analyzed from a fluid simulation of the first embodiment.

The hot air that has flown into the lower layer portion is dragged by the negative pressure of the fan, flows in the direction of arrow 160, flows into the fan layer 162 as by arrow 161, and returns to the fan 133. The returned air is once again blown in the direction of the arrow 150. The present embodiment takes a configuration wherein a part of the hot air blown onto a part of the print medium is recovered and circulated. The print medium admission port 105 and discharge port 106 are open to the outside air. The present inventors have carried out a fluid simulation of the above structure, and quantified the flow rate. The results are shown in FIG. 9A. The flow rate of the arrow 152 portion expresses the flow rate from the fan layer 162 entering into the upper layer portion 158, and the flow rate of the arrow portion 160 expresses the flow rate from the upper layer portion 158 returning to the fan layer 162. As they are on the outward flow side and the suction side flow respectively, the flow rates are shown inversely as plus and minus. As the admission port 105 and discharge port 106 are the regions in which hot air leaks out and the other portions are sealed, it is possible to know the circulation rate by comparison of the flow rates of the above arrow 152 portion and arrow 160 portion. As can be understood from FIG. 9A, both sides are approximately equal and the circulation rate is approximately 100%. This is because the flow that attempts to exit from the admission port 105 and the discharge port 106 is pulled back by the negative pressure of the fan 133. Because a circulation rate of approximately 100% is realized, air heated by the hot air heater 135 returns as is to the axial flow fan 133 almost entirely without mixing with outside air.

Figure 9B:
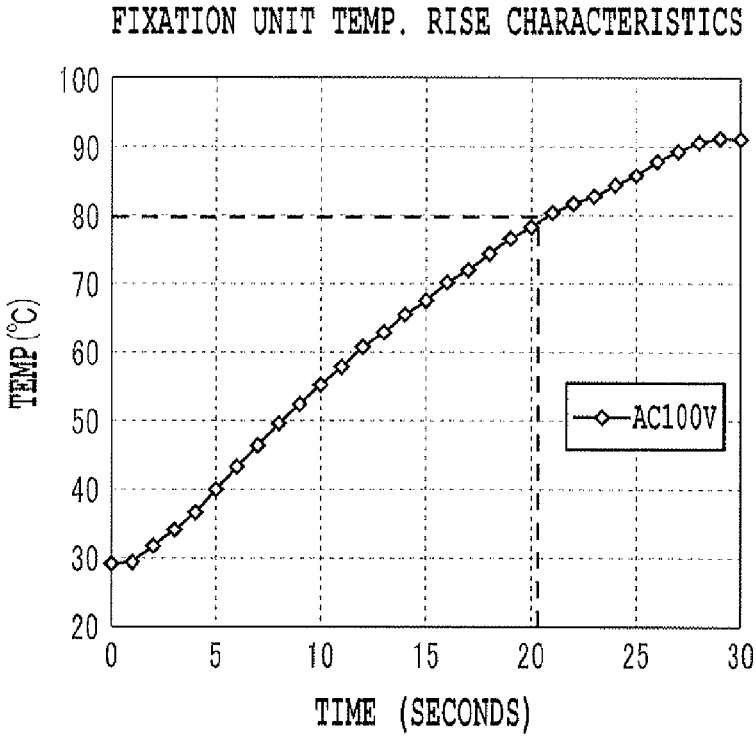
FIG. 9B is a graph illustrating the temperature rise characteristics of the fixation unit of the first embodiment.

FIG. 9B is a chart that shows the temperature rise characteristics of the fixation unit, due to the configuration above. When 100V, that is, 200 W of energy is applied to the hot air heater 135, the circulating hot air rises from approximately 30° C. to 80° C., the preset temperature of the fixation unit, in approximately 20 seconds. In order to decrease the rising time 200 W is applied, only when rising, and after reaching 80° C. for a moment, 80° C. can be maintained even if the applied electric power is decreased down to 40V, that is, 32 W. Here, for example, in the case where the outside temperature (ambient temperature) is 25° C. and the relative humidity is 40%, by the hot air rising to 80° C. the initial relative humidity of the hot air inside the fixation unit decreases to 2.7 percent.

Figure 10:
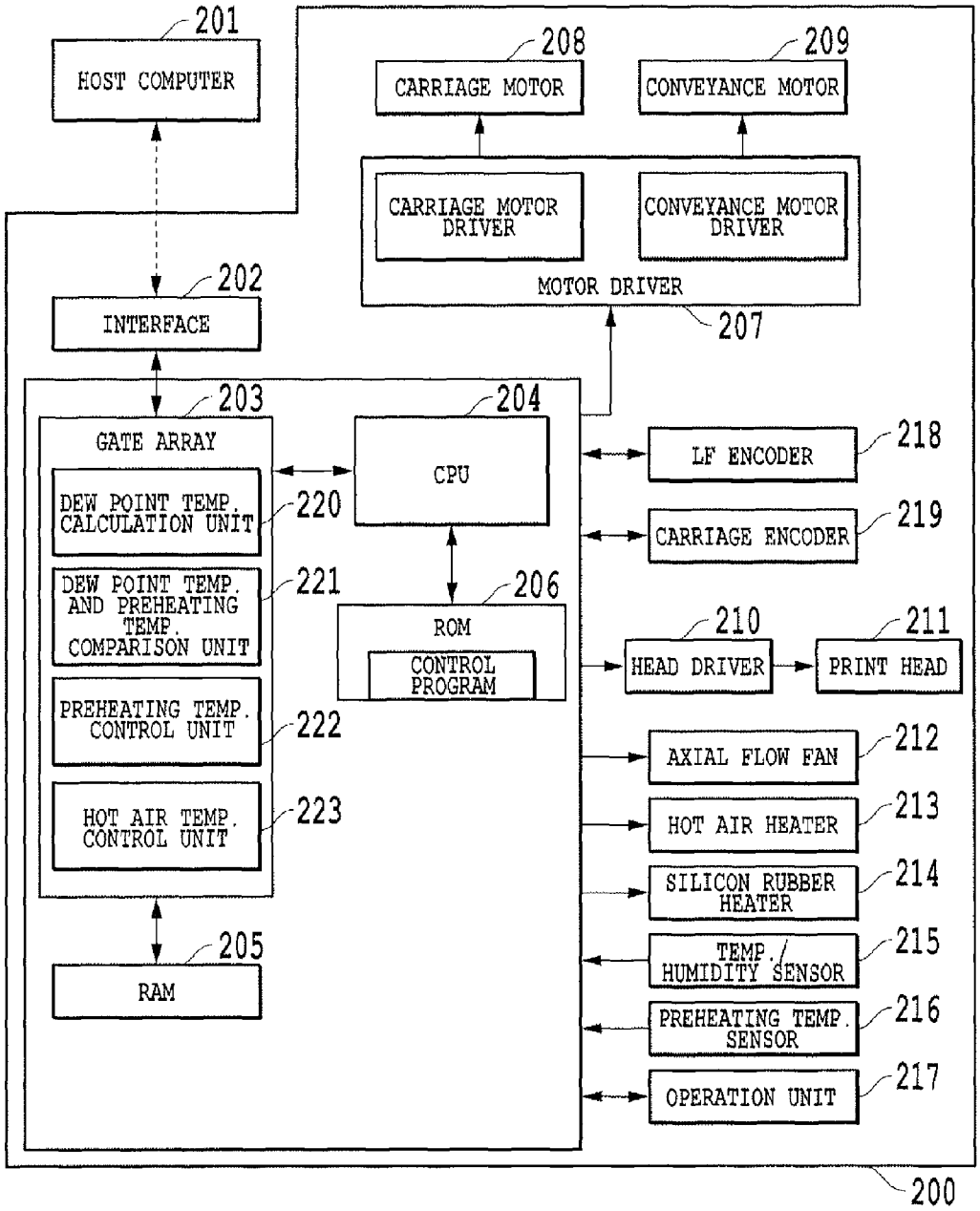
FIG. 10 is a block diagram that shows the control structure of the inkjet printing apparatus, including control of the drying and fixation caused by the fixation unit of the first embodiment.

FIG. 10 is a block diagram that shows the control structure of the inkjet printing apparatus of the present embodiment, including control of the drying and fixation caused by the above described fixation unit.

In the above figure the inkjet printing apparatus 200 is connected to the host computer 201 through the interface 202, receives print data from the host computer 201, and returns various types of statuses to the host computer 201. When print data is sent from the host computer 201, it is temporarily stored in the RAM 205 via a gate array 203. After this the print data is converted from raster data to bit map data by the gate array 203, and once again stored in the RAM 205. The bit map data is sent through the gate array 203 and the head driver 201 to the print head 211, and printing is performed by ejecting ink onto the print medium from the print head. The ROM 206 stores various types of programs such as printing apparatus control programs, including the processes later described at FIG. 11 and the like, and control operations are performed at the CPU 204 while referencing these control programs. The motor driver 207 controls the carriage motor 208 and the paper conveying motor 209. 218 and 219 denote a LF encoder and a carriage encoder respectively, and motor control is carried out by detecting the moving distance and moving speed from the respective encoder signals and giving feedback to the corresponding motors.

The axial flow fan 212 shown in FIG. 10 corresponds to the axial flow fan 133 shown in FIG. 7A. In similar fashion, the hot air heater 213 corresponds to the hot air heater 135 shown in FIG. 7A. Similarly, the preheating use silicon rubber heater 214 corresponds to the above mentioned silicon rubber heater 101, and the temperature/humidity sensor 215 corresponds to the temperature/humidity sensor 145. The preheating temperature sensor 216 is a sensor that detects the temperature of the silicon rubber heater 214, that is, the preheating temperature, and corresponds to the preheating temperature sensor 136 mentioned above at FIG. 7A. The operation unit 217 is configured to have a key that receives a key operation from a user, and a display unit or the like that notifies the user of an error or the like. The calculation unit 220 obtains the dew point temperature from the detected temperature and humidity information. More concretely it calculates in the manner below.

First, the saturated vapor pressure es (t) at a temperature t (° C.), detected by the temperature/humidity sensor 215, is obtained from the temperature t using Tetens' formula, below.

$$es(t)=6.11\times10^{7.5t/(237.3+t)}(\text{hPa}) \quad \text{[Equation 1]}$$

Next, the current vapor pressure e is obtained from the relative humidity r (% RH) detected from the temperature/humidity sensor 215, using the equation below.

$$e=es(t)\times r/100(\text{hPa}) \quad \text{[Equation 2]}$$

Here, because the temperature at the time when e has become the saturated vapor pressure is the dew point temperature, the dew point temperature td is obtained by the equation below.

$$td=237.3\times\log(e/6.11)/(7.5\times\log(10)+\log(6.11/e))(^\circ\text{C.}) \quad \text{[Equation 3]}$$

As an alternative to the method of calculating the saturated vapor pressure and dew point pressure as outlined above, a method may be also acceptable wherein a saturated water vapor pressure chart is stored in advance as a table, and the dew point temperature is ascertained from the temperature and humidity at that time.

The comparison unit 221 compares the dew point temperature td obtained in the above manner by the dew point temperature calculation unit 220 with the temperature detected by the preheating temperature sensor 216. Next, the preheating temperature control unit 222 controls the temperature of the silicon rubber heater 214 based on the result of this comparison. In the present embodiment a target temperature is set and on/off control of the silicon rubber heater 214 is performed such that the temperature detected by the preheating temperature sensor 216 becomes 5° C. higher than the dew point temperature.

The hot air temperature control unit 223 controls such that the hot air temperature becomes the target temperature 80° C. FIG. 12B is a graph plotting the dew point temperature against relative humidity in the case where the hot air temperature is 80° C. From this graph, for example, in the case where the relative humidity of the hot air inside the fixation unit has risen up to 8% RH due to ink evaporation caused by printing and the drying and fixation of the printed imaged, the dew point temperature is approximately 28° C. Thus, in the case where the ambient temperature is less than 28° C. condensation occurs on the print medium. That is, the temperature of a print medium conveyed inside the fixation unit without performing a heating or some other process that raises the temperature after printing is approximately the same temperature as the ambient temperature. Because of this, in the above example, in the case where the ambient temperature is less than 28° C. condensation on the print medium occurs. As a result there are occasions where ink that has adhered to the print medium does not dry, and rather, moisture in the print medium increases.

In the present embodiment, in order to prevent this type of drying failure and moisture increase, preheating of the print medium before entering the fixation unit is performed by a silicon rubber heater 214. For example, the ink moisture evaporation amount per unit of time increases, and the relative humidity of the air inside the fixation unit rises in a short time, more so in an apparatus in which the throughput when continuously printing is high. Thus, because the dew point temperature rises, as shown in FIG. 12B, as the relative humidity increases, the preheating temperature also increases along with the increase in the number of continuously printed pages and print duty (amount of ejected ink). Conversely, in the present embodiment, when the temperature of the silicon rubber heater 214 is 5° C. or more higher than the dew point temperature in a state where this preheating unit is not driven, the silicon rubber heater is not driven. For example, when the outside temperature is 25° C. and air with a relative humidity of 40% is elevated to 80° C., the initial relative humidity of hot air inside the fixation unit decreases to 2.7 percent, and the dew point temperature becomes 10.6° C. In this case, because the temperature of the print medium, which is the same temperature as the outside air, is 14.4° C. higher, condensation will not occur even without preheating. When the humidity raises to 6.5% the dew point temperature rises to 25° C. for the first time, and hence preheating becomes necessary. In the present embodiment temperature control is carried out with a 5° C. margin.

Figure 11B:
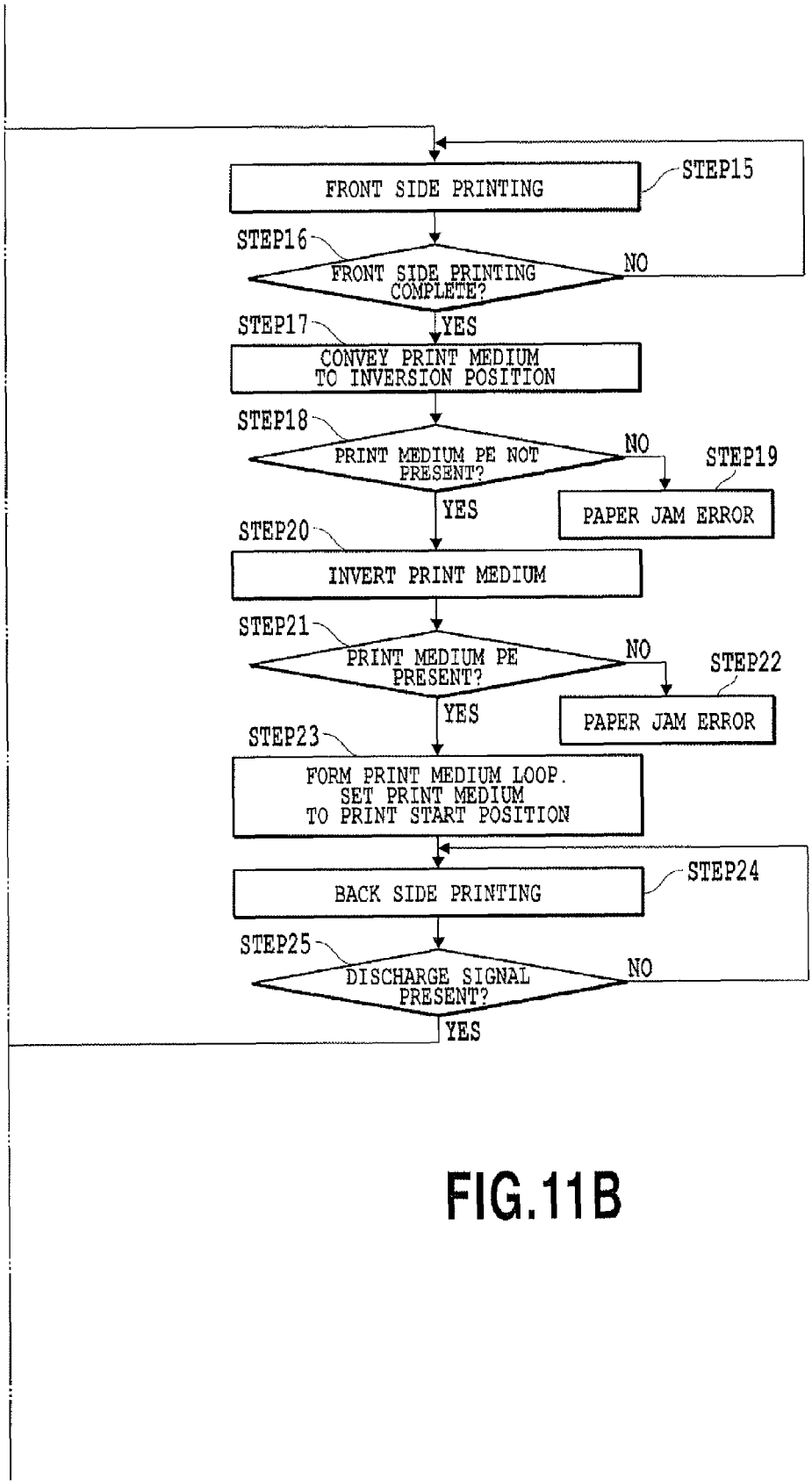

FIGS. 11A and 11B are flowcharts that illustrate the printing processes that accompany the printed image fixation process of the printing apparatus of the present embodiment described above.

In FIGS. 11A and 11B, the apparatus is powered on at step 1. Next, when a print signal is input from the host computer at step 2, at step 3 a temperature control subroutine relating to the fixation unit is started.

Figure 12A:
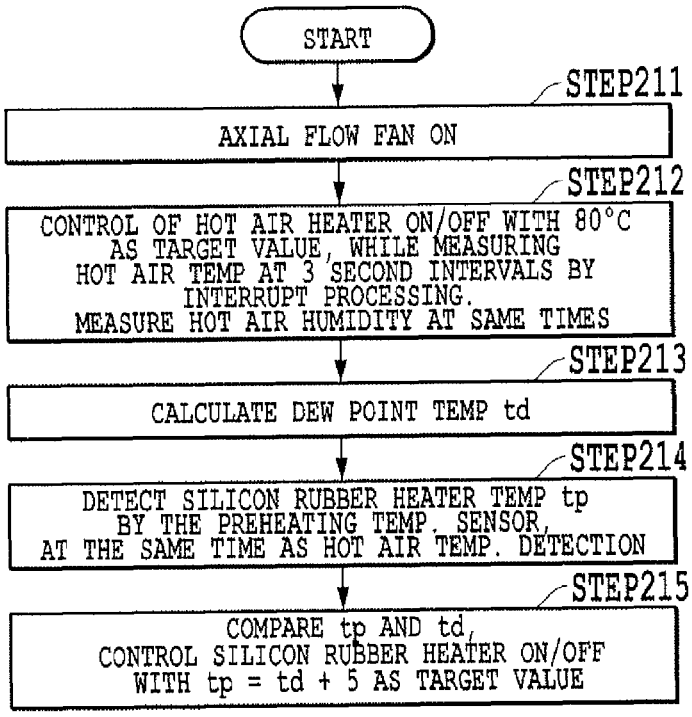
FIG. 12A is a flowchart illustrating a subroutine process concerning the temperature control at the fixation unit of the first embodiment.
Figure 12B:
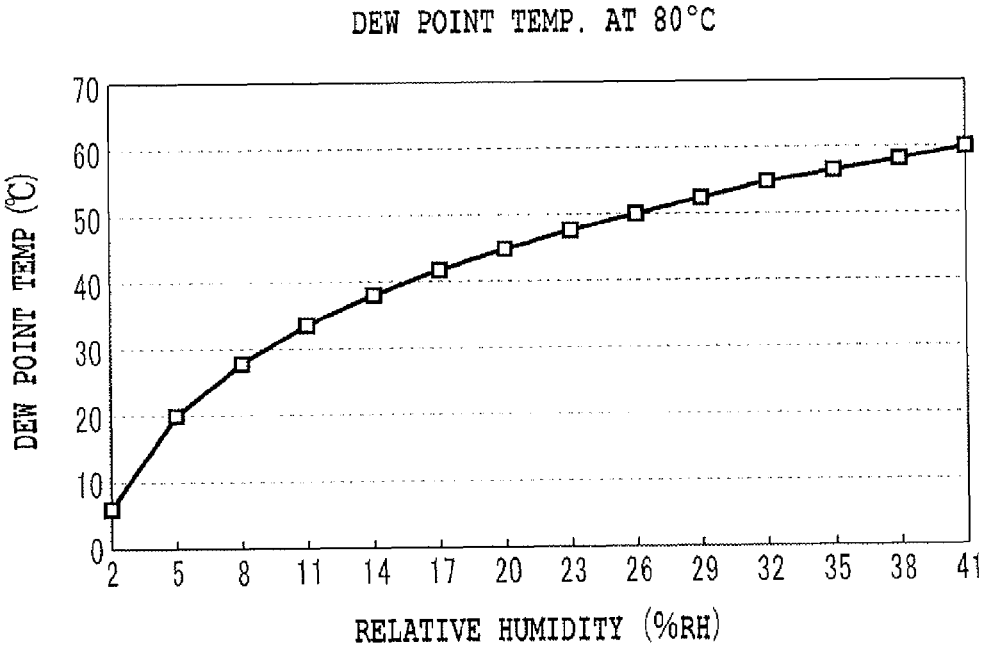
FIG. 12B is a graph plotting the dew point temperature against relative humidity in the case where the hot air temperature at the above fixation unit is 80° C.

FIG. 12A is a flowchart illustrating the subroutine processes concerning the temperature control at the fixation unit. As shown in FIG. 12A, first, at step 211, driving of the axial flow fan is commenced and airflow is generated into the fixation unit. Next, at step 212, while detecting the temperature of the airflow (hot air) at 3 second intervals, the hot air heater is controlled on and off for the target temperature of 80° C. The humidity of the hot air is also detected at the same timing as the temperature detection. At step 213 the dew point temperature td (° C.) is calculated as mentioned above, based on the hot air temperature and humidity results detected above. For example, in the case where the temperature is 80° C. and the relative humidity is 5% RH, td=20.2° C., and in the case where the temperature is 80° C. and the relative humidity is 20% RH, td=44.8° C.

At step 214 the silicon rubber heater temperature tp is detected by the preheating temperature sensor, at the same time as the above mentioned hot air temperature detection. Next, at step 215, the dew point temperature td and the preheating temperature tp are compared, and driving of the silicon rubber heater is set to off in the case where tp>td+5, and driving of the silicon rubber heater is set to on in the case where tp≤td+5. As described above, the temperature of the print medium, which has been conveyed on the front surface of the silicon rubber heater having the detected temperature tp and subjected to preheating, does not drop more than 3° C. below the temperature tp at the time it enters the fixation unit. Therefore, the on and off controlling of the driving of the silicon rubber heater with tp=td+5 as the target is performed, it is possible to control the temperature of the print medium such that it becomes 2° C. or more higher than the dew point temperature td. As a result it is possible to prevent the occurrence of moisture condensation in the hot air and to prevent the adhesion of moisture to the print medium, thus enabling the elevation of the drying efficiency of the print medium. The above subroutine process is continued until printing is completed.

Referring again to FIGS. 11A and 11B, after starting the fixation unit temperature control mentioned above, feeding is performed at step 4, and at step 5 the passage of the front edge of the print medium is detected by the PE sensor provided just before the LF roller. When the front edge is not detected by the PE sensor, at step 6 paper jam error related processing is performed.

When passage of the front edge of the print medium is detected, at step 7, after the front edge of the print medium has impacted the nip of the LF roller, it is conveyed 3 mm further to create a print medium loop and set it at the print start position. Because of this loop it is possible to prevent the print medium being from conveyed at an angle, that is, it is possible to prevent so-called obliquely conveyed motion. Next, at step 8 it is determined whether single-sided or double-sided printing will occur, and when it is determined that single-sided printing will occur, at step 9 printing is performed by repeatedly performing scanning of the print head and conveying of the print medium. Next, at step 10, it is determined whether or not there is a discharge signal, and when a there is a discharge signal discharge of the print medium occurs at step 11, and printing continues where there is not. After discharge of the print medium, at step 12, it is determined whether or not there is a next page that should be printed, and where there is a next page the process returns to step 4 and the same operations are repeated. When there is not a next page, at step 13 the temperature control subroutine relating to the fixation unit is completed, and the axial flow fan, hot air heater and silicon rubber heater are turned off. Lastly at step 14 power is turned off and the present process is brought to a close.

At step 8, when it is determined that double-sided printing will occur, at step 15 printing of the front side is performed. Next, at step 16, it is determined whether or not front side printing has completed, printing is continued in the case where it has not completed, and when it has completed, at step 17 the print medium is conveyed to the inversion position and stopped momentarily as described earlier while referring to FIG. 1. Next, at step 18, it is determined whether or not the PE sensor has detected the print medium, and when the print medium is not detected it is determined that a jam has occurred, and at step 19 paper jam error related processing is performed. When the print medium has been conveyed normally, at step 20 the print medium is inverted and conveyed. After that, the print medium is wound around the U-turn conveyance unit 3 (FIG. 1) and once again conveyed to the PE sensor position. Next, at step 21, it is determined whether or not there is a print medium at the PE sensor, and when it is determined that there is no print medium it is determined that a jam has occurred, and at step 22 paper jam error related processing is performed. In the case where the print medium has been conveyed normally, at step 23, after a print medium loop has been created, it is set to the print start position. Next, at step 24, back side printing is performed, and at step 25 it is determined whether or not there is a discharge signal. When there is a discharge signal discharging of the print medium is performed at step 11, and thereafter the same processes as that of single-sided printing are repeated. When there is not a discharge signal back side printing is continued. It should be noted that, at the time of inversion for back side printing, even where inverting without inserting a waiting period at the time of inversion, ink stripping or transfer will not occur because the ink applied on the print medium when printing the front side has dried sufficiently. Thus, the temperature fall of the print medium, whose temperature has been momentarily raised by the silicon rubber heater and hot air, is very small and condensation of moisture contained in the hot air inside the fixation unit after inversion largely does not occur. However, in the case of apparatuses where the conveyance speed is slow, if the temperature drop at the time of double-side inversion is forecasted and the preheating temperature set higher in advance it is also possible to entirely prevent condensation when printing on both sides.

It should be noted that while a silicon rubber heater, which raises print medium temperature by heat conduction, is used as the preheater in the embodiments described above, the heating mechanism is not limited as such and a system that uses an infrared heater and to give off radiant heat is also acceptable. In this case, when taking into account the infrared absorption properties of the moisture in the ink and adjusting the energy wavelength of the infrared heater to a wavelength on the order of 2.5 to 3.5 micro meters, which is the high absorption characteristic range of water, a high heating efficiency can be obtained. Also, while in the above embodiment a method is used wherein the print medium is heated by a preheater after printing, because it is acceptable if the temperature of the print medium rises before entering the fixation unit, a method wherein the print medium is heated before ink has been applied to the print medium may also be employed. For example, a planar heater may be mounted such as to wind around the print medium guiding unit of one portion (the downstream side is preferable) of the U-turn conveying unit. Because there is a temperature drop after the print medium has exited the U turn conveyance unit and before it has entered the fixation unit it is preferable to set the heater temperature while anticipating this drop. As another embodiment, as an alternative to mounting the heater to the guide portion of the U-turn conveying unit, there is also a configuration wherein space is provided between the U-turn conveying unit and the platen unit, a pair of rollers is provided at this space, and one of these rollers is made a heating roller such as an electrophotographic type fixation roller. In the case of this configuration, because the print medium is held between a pair of rollers, the thermal resistance between the roller and the print medium is small, and there is an advantage in that the preheating efficiency is increased.

Also, the position where the preheating mechanism is provided may be at a position other than, as described above, a position before or after ink is applied, that is, it may be at a position at the platen. By mounting a planar heater on the back side of the platen and heating the platen it is possible to raise the temperature of the print medium before it enters the fixation unit on the downstream side.

Regarding the preheating position, as explained above, it may be upstream of the range in which hot air flows. That is, a portion of the preheating mechanism may extend inside the range in which hot air flows or to the downstream side of the flow range.

Furthermore, the print medium conveyance structure is not limited to a configuration that uses a roller and platen as in the above embodiment; it may also be a structure that attracts the print medium onto a belt by way of static electricity or negative pressure. In this case a hot air fixation furnace is provided on the downstream side of the print head above the conveyance belt, and a planar heater is provided back of the conveyance belt, upstream of the hot air fixation furnace. In order to make the frictional resistance with the belt small a ceramic heater or the like is preferred. Heat is transferred from this heater to the print medium via the conveyance belt, and the temperature of the print medium is raised. In the case of this example, because the print medium is attracted onto the belt, the thermal resistance between the belt and the print medium becomes small, and it is possible to efficiently transfer heat from the heater to the print medium.

According to the above embodiment, because the dew point temperature rises due to continuous printing or the like, and because preheating is performed only in the case where the condition tp≤td+5 (FIG. 12A) is satisfied, it is possible to achieve conservation of electric power.

(Embodiment 2)

In the first embodiment described above the temperature of the silicon rubber heater is measured by a preheating temperature sensor (thermistor), and based on this measured temperature, the temperature of the print medium passing over the silicon rubber heater is specified and acquired by experiment. In contrast to this, in a second embodiment of the present invention, without providing a sensor that measures the temperature of the silicon rubber heater, a sensor is provided that directly measures the temperature of the silicon rubber heater or the temperature of the print medium conveyed over it. Only the configuration of this print medium temperature detection that differs will be explained below.

Figure 13A:
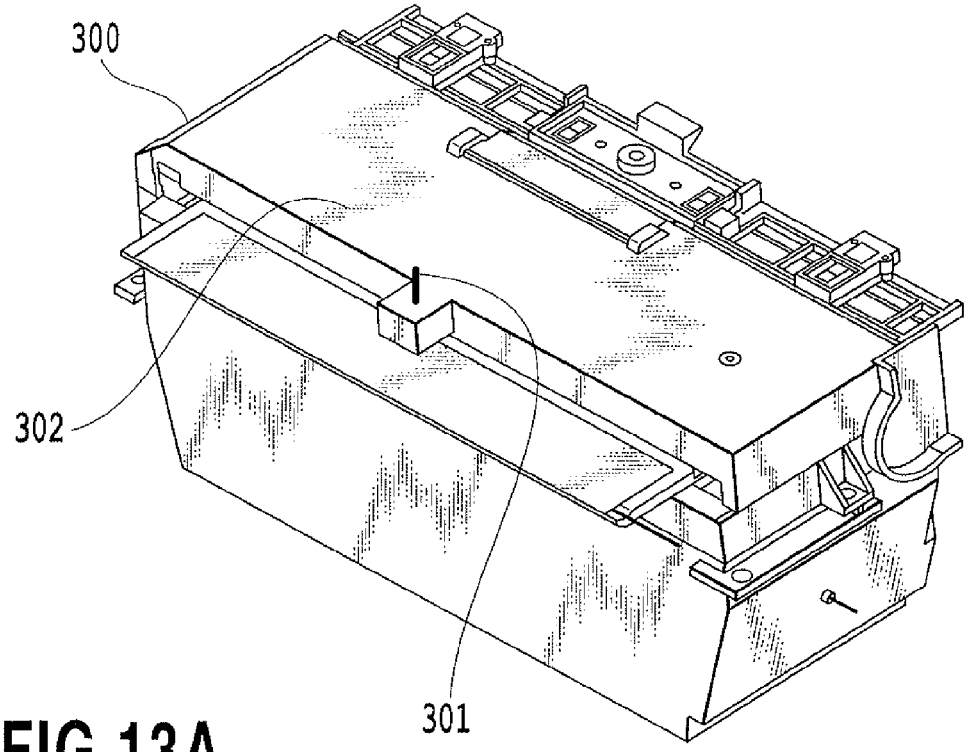
FIG. 13A is a perspective view that illustrates the fixation unit of a second embodiment of the present invention.
Figure 13B:
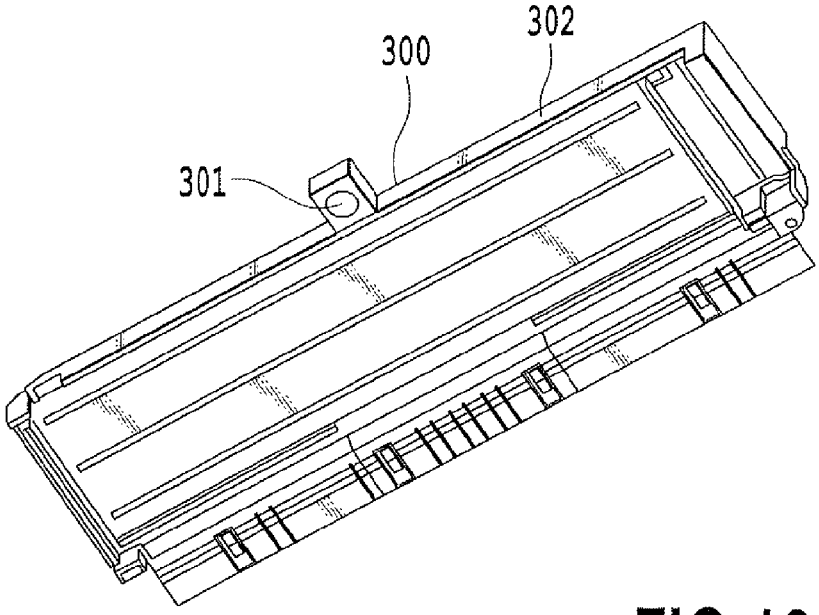
FIG. 13B is a perspective view of the top cover unit of this fixation unit, viewed from the lower side.

FIG. 13A is a perspective view that illustrates the fixation unit of a second embodiment of the present invention, and FIG. 13B is a perspective view of the top cover unit 300 of the fixation unit, viewed from the lower side. In these figures the top cover 302 has an analogous form to that of the first embodiment described above, however, it has a different feature wherein an infrared thermometer is positioned and fixed. Furthermore, the thermistor that was mounted in the first embodiment is not mounted. The infrared thermometer 301 has a structure that concentrates infrared light radiated from an object via a lens, and focuses it onto a detection element called a thermopile. An electric signal is obtained from the thermopile in accordance with the intensity of the infrared rays. Due to this it is possible, without making contact, to measure the temperature of the silicon rubber heater and the print medium conveyed over this heater, and temperature measurement having a high response speed is enabled. Also, because the temperature of the print medium is directly measured it is not necessary to consider the temperature difference between the silicon rubber heater and the print medium, as in the first embodiment; it is acceptable to only take into account sensor error.

Figure 14:
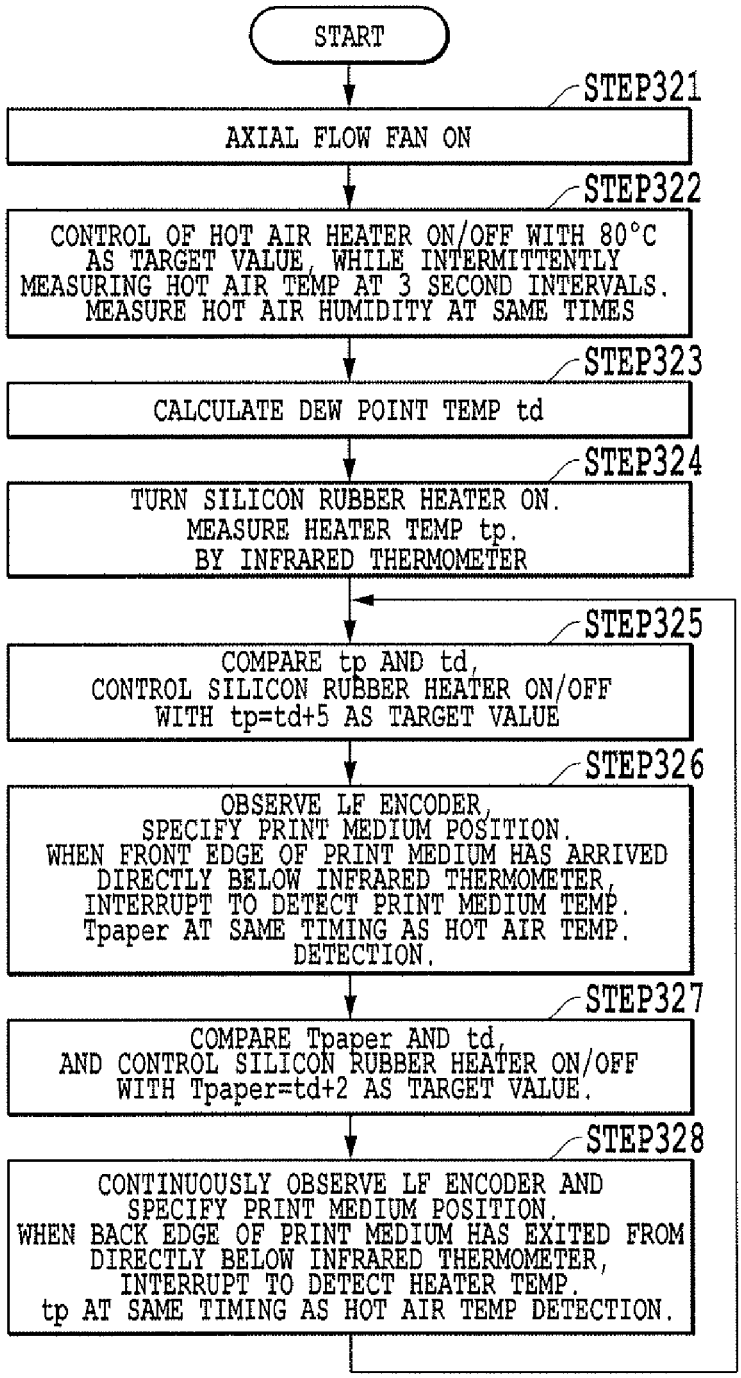
FIG. 14 is a flowchart illustrating the process of the temperature control subroutine relating to the fixation unit of the second embodiment.

FIG. 14 is a flowchart illustrating the process of the temperature control subroutine relating to the fixation unit of the present embodiment. It should be noted that the overall process of the printing operation is the same as that of the first embodiment shown at FIG. 11, and as such this explanation has been omitted.

In FIG. 14, at step 321, driving of the axial flow fan is commenced and airflow is generated into the fixation unit. Next, at step 322, while detecting, at 3 second intervals, the temperature of the airflow (hot air) circulated by the above fan, driving of the hot air heater is turned on and off with 80° C. as the target temperature, and the temperature is controlled. The humidity of the hot air is also detected with the same timing. At step 323 the dew point temperature td (° C.) is calculated, based on the hot air temperature and humidity detected above. Next, at step 324, driving of the silicon rubber heater is set to ON, and the heater temperature tp is measured by the infrared thermometer 301. Next, at step 325, the measured heater temperature tp and the dew point temperature td are compared, and driving of the silicon rubber heater is controlled on and off with the print medium temperature tp=td+5 as the target value. Next, at step 326, after the print medium forms a loop, the position of the print medium is specified by observing the LF encoder. Next, after the front edge of the print medium has arrived inside the measurement range directly below the infrared thermometer 301, it is determined to switch from measuring the silicon rubber heater to measuring the print medium front surface temperature Tpaper, and Tpaper is detected.

Next, at step 327, the print medium temperature Tpaper and the dew point temperature td are compared, and the silicon rubber heater is controlled on and off with Tpaper=td+2 as the target value. Next, at step 328, while continuously identifying the position of the print medium, when the back edge of the print medium has exited from directly beneath the infrared thermometer 301, it is determined once again to switch to the temperature of the silicon rubber heater, the heater temperature tp is detected, and the process returns to step 325. In the above manner the target value of the temperature control is changed according to whether or not the print medium is located directly beneath the infrared thermometer.

In the second embodiment described above, because the print medium temperature is directly measured it is possible to disregard floating of the print medium and the influence of paper thickness and material, enabling more accurate temperature control. Because of this, it is possible for it to be applied in the case where a print medium other than paper is used, such as plastic or metal for example, and it has an advantage in that it can deal with a wide variety of print mediums.

(Embodiment 3)

The above described first and second embodiments provide a mechanism that detects the temperature and humidity of the hot air, and the temperature of the preheater (the silicon rubber heater). However, even without detecting the temperature of the preheater or the print medium it is possible to control the temperature of the preheater that heats the print medium based on the dew point temperature and the ambient temperature. A third embodiment of the present invention has a simplified configuration in which the sensor that detects the temperature of the preheater is omitted.

In the apparatus of the present embodiment, a temperature sensor is provided inside the apparatus in order to check internal temperature rise and compensate for variation in the ejection amount with temperature. Although omitted from the figure, a thermistor is provided on the main board of the apparatus, which enables temperature measurement inside the mechanism. By providing this internal temperature sensor at a location away from sources of heat generation such as the vicinity of the motor the temperature that the sensor detects is largely indicative of the ambient temperature. The temperature of the print medium before it is heated by the preheater can also be regarded as approximately the same as the ambient temperature. On the other hand, the relationship between the electric power applied to the silicon rubber heater and the temperature rise of the print medium are figured out in advance by experiment, and this data is stored in the ROM 206 (FIG. 1) as a table. In the present embodiment it is ascertained that a temperature rise of approximately 1.5° C. can be expected per 1 W applied. Thus the temperature of the print medium may be held above the dew point temperature by applying electric power in accordance with a table, based on the difference between the ambient temperature and dew point temperature above. Preferably an amount of electric power larger than necessary for temperature maintenance is applied only at the time of raising the temperature, and the time interval for raising the temperature is shortened.

Figure 15:
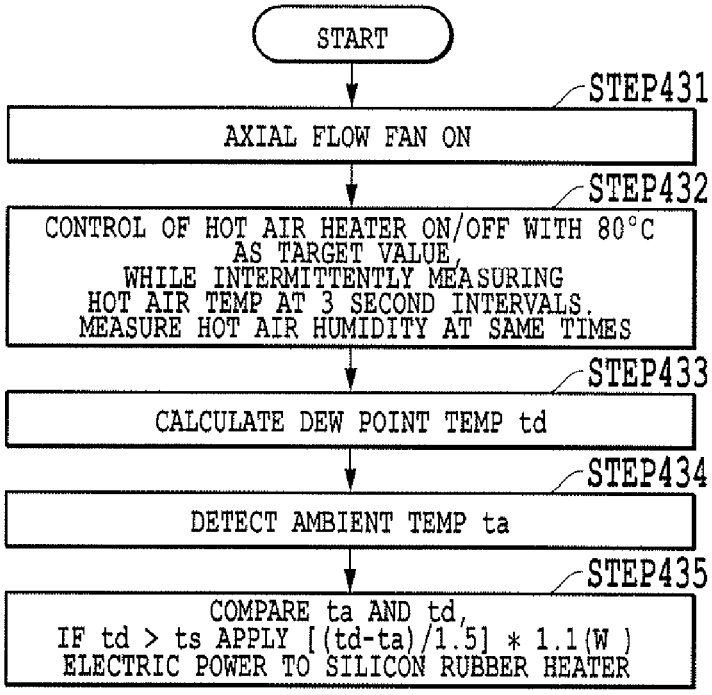
FIG. 15 is a flowchart illustrating the process of the temperature control subroutine of the fixation unit of a third embodiment of the present invention.

FIG. 15 is a flowchart illustrating the process of the temperature control subroutine of the fixation unit of the present embodiment. First, at step 431, the axial flow fan is turned on. Next, at step 432, while detecting the temperature of the hot air at 3 second intervals, the hot air heater is controlled on and off with 80° C. as the target temperature. The humidity of the hot air is also detected with the same timing. Next, at step 433 the dew point temperature td (° C.) is calculated based on the hot air temperature and humidity detected above. Next, at step 434, the ambient temperature to is detected. Next, at step 435, the ambient temperature is compared with the dew point temperature, and in the case where the ambient temperature is lower, [(td−ta)/1.5]×1.1(W) of electric power is applied to the silicon rubber heater, according to the temperature difference. That is, because a temperature rise of approximately 1.5° C. is expected per 1 W applied, the temperature difference is divided by 1.5, and a slightly larger power is applied by applying a safety factor of 10%. Due to this it is possible to make the temperature of print medium entering the fixation unit higher than the dew point temperature of the hot air inside the fixation unit.

According to the above embodiment, because the temperature of the preheater and the printing medium are not detected it is possible to omit the corresponding structure. It should be noted that in the present embodiment because the temperature of the print medium is not directly measured, it is preferable to compensate for cumulative error by a safety factor.

(Embodiment 4)

The third embodiment above uses a mechanism that detects ambient temperature; however, the present invention can also be applied to a configuration in which this mechanism is not necessary. As for some printing apparatuses, equipment exists wherein the temperature and humidity of the location in which the printing apparatus is installed is regulated such that it is held within a prescribed range (for example, a large scale inkjet printing apparatus or the like). For example, in the case where the ambient temperature of the installation site is regulated between 25 and 35° C., it is possible to calculate the dew point temperature, and carry out control with the ambient temperature to set at 25° C. That is, by way of its relationship to the calculated dew point temperature td (° C.), moisture condensation at the print medium inside the fixation unit can be prevented by applying [(td-25)/1.5]*1.1 (W) electric power to the silicon rubber heater. Also, in the case where the humidity of the installation location is regulated between 30 and 40% in addition to the temperature between 25 to 35° C., it is possible to obtain in advance the maximum humidity inside the fixation unit when performing the printing of an envisaged image (maximizes at 35° C., 40%). For example, in the case where the high relative humidity of the hot air of the fixation unit is 20% at 80 ° C., according to the relationship shown at FIG. 12B the dew point temperature is approximately 45° C. at the most. Therefore, by way of applying an amount of electric power to the silicone rubber heater to raise it 20° C. from 25° C. to 45° C., it is possible to maintain the temperature of the preheater, and consequently the temperature of the print medium, above the dew point temperature. In the case of this example a hot air humidity sensor inside of the fixation unit is also not necessary, the temperature is controlled by detecting only the temperature of the hot air, and it is possible to prevent moisture condensation on the print medium and to maintain a high drying efficiency if a prescribed power is applied to the preheater.

It should be noted that all configurations that implement fixation processing of an object printed by an inkjet printing apparatus are within the purview of the present invention, regardless of the form. That is, this fixation process uses a fixation mechanism that is provided with a device that blows hot air onto a print medium printed by an inkjet printing apparatus and a structure that returns the hot air blown onto the print medium to the blowing device. Also, before the hot air is blown by the above fixation unit, preheating is carried out in order to heat the print medium. Furthermore, by controlling the energy used for heating at the above preheater, it is possible to make the temperature of the heated print medium higher than the dew point temperature of the hot air at the above fixation mechanism.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-105697, filed Apr. 30, 2010, which is hereby incorporated by reference herein in its entirety.

What is claimed is:

1. A printing apparatus comprising:

a printing unit having an inkjet head that carries out printing on a print medium;

a drying unit configured to dry the print medium on which printing is performed by said printing unit while being conveyed along a conveying direction, said drying unit having (i) an admission port through which the print medium enters into said drying unit, (ii) a discharge port through which the print medium is discharged from said drying unit, (iii) a platen on which the print medium is conveyed in said drying unit, (iv) a first heater to generate hot air, and (v) a circulation structure to flow the hot air over a printed surface of the print medium across the conveying direction and to return the flowing hot air through a return duct provided under the print medium so as to form a circulation of the hot air around the print medium in said drying unit; and a preheating unit having a second heater, provided on a part of said platen in a vicinity of said admission port, for heating the print medium to raise the temperature of the print medium at an upstream side of said drying unit, wherein the second heater has a contact surface contacting the conveyed print medium on its back side before entering into said drying unit, and the contact surface has a width corresponding to the maximum width of the print medium used, and wherein the temperature of the print medium heated by said preheating unit is made higher than dew point temperature of the hot air in said drying unit.

2. The printing apparatus according to claim 1, further comprising (i) a first detection unit that detects temperature of the hot air, (ii) a second detection unit that detects humidity of the hot air and (iii) a control unit that obtains the dew point temperature of the hot air based on the results detected by said first detection unit and said second detection unit, and controls the energy for heating that is applied to said preheating unit.

3. The printing apparatus according to claim 2, further comprising a third detection unit that detects ambient temperature, wherein said control unit controls the energy applied to said preheating unit based on the difference between the ambient temperature detected by said third detection unit and the dew point temperature.

4. The printing apparatus according to claim 2, further comprising a third detection unit that detects the temperature of said preheating unit, wherein said control unit controls the energy applied to said preheating unit based on the difference between the temperature detected by said third detection unit and the dew point temperature.

5. The printing apparatus according to claim 2, further comprising a third detection unit that detects the temperature of the print medium before the print medium has entered, by conveyance, the vicinity of said admission port, wherein said control unit controls the energy applied to said preheating unit based on the difference between the temperature detected by said third detection unit and the dew point temperature.

* * * * *